US007165992B1

(12) United States Patent
Schiaffino

(10) Patent No.: US 7,165,992 B1
(45) Date of Patent: Jan. 23, 2007

(54) CEILING ELECTRICAL CONNECTOR ASSEMBLY

(76) Inventor: Mario A. Schiaffino, 101 W. Chestnut, Bridgeport, KS (US) 67416

( * ) Notice: Subject to any disclaimer, the term of this patent is extended or adjusted under 35 U.S.C. 154(b) by 0 days.

(21) Appl. No.: 11/368,291

(22) Filed: Mar. 3, 2006

(51) Int. Cl.
*H01R 13/66* (2006.01)

(52) U.S. Cl. ..... 439/537

(58) Field of Classification Search ..... 439/537, 439/334, 337, 351
See application file for complete search history.

(56) References Cited

U.S. PATENT DOCUMENTS

| | | | | |
|---|---|---|---|---|
| 1,834,318 | A | 12/1931 | Phillips | |
| 3,302,918 | A | 2/1967 | Cohen | |
| 3,356,840 | A | 12/1967 | Cohen | |
| 3,798,584 | A | 3/1974 | Person | |
| 3,945,702 | A * | 3/1976 | Poliak et al. | 439/337 |
| 4,414,617 | A | 11/1983 | Galindo | |
| 4,645,286 | A | 2/1987 | Isban et al. | |
| 4,645,289 | A | 2/1987 | Isban | |
| 4,780,089 | A | 10/1988 | Wernick | |
| 4,952,157 | A | 8/1990 | Hudson et al. | |
| 5,046,961 | A * | 9/1991 | Hoffman | 439/141 |
| 5,108,297 | A * | 4/1992 | Hoffman et al. | 439/134 |
| 5,134,554 | A | 7/1992 | Donato et al. | |
| 5,234,355 | A * | 8/1993 | Sosinski et al. | 439/337 |
| 5,440,469 | A | 8/1995 | Gomes | |
| 5,558,537 | A | 9/1996 | Su | |
| 5,645,446 | A * | 7/1997 | Getselis et al. | 439/419 |
| 6,146,191 | A | 11/2000 | Kerr, Jr. et al. | |
| 6,503,099 | B2 | 1/2003 | Kerr, Jr. | |
| 6,761,540 | B2 * | 7/2004 | Tseng | 416/244 R |
| 6,780,049 | B1 | 8/2004 | D'Angelo et al. | |
| 6,799,982 | B2 * | 10/2004 | Kerr, Jr. | 439/180 |
| 6,997,740 | B2 * | 2/2006 | Kerr | 439/537 |
| 2002/0163812 | A1 | 11/2002 | Tseng | |
| 2003/0148659 | A1 * | 8/2003 | Walker et al. | 439/537 |
| 2005/0272306 | A1 * | 12/2005 | Kerr, Jr. | 439/537 |

* cited by examiner

*Primary Examiner*—Tulsidas C. Patel
*Assistant Examiner*—Harshad C. Patel
(74) *Attorney, Agent, or Firm*—Kenneth H. Jack; Davis & Jack, L.L.C.

(57) ABSTRACT

A connector assembly for interconnecting an overhead electric junction box and electric fixture, the connector assembly including a socket housing having first and second apertures, each aperture having a hook engaging end and a hook disengaging end, the socket housing internally supporting first and second lands, the first and second lands overlying the first and second apertures' hook engaging ends; a plug housing having a first and second hook, each hook being composed of an electrically conductive material, the first and second hooks being movable between the first and second apertures' hook engaging and hook disengaging ends; upper terminals connected operatively to the socket housing, the upper terminals having upper and lower ends, the upper terminals' upper ends being adapted for electrical connections with structural power wires, the upper terminals' lower ends being adapted for, upon extensions of the first and second hooks into the first and second apertures, electrically contacting the first and second hooks; lower terminals connected operatively to the plug housing, the lower terminals being adapted for electrically connecting the first and second hooks to the electric fixture's network of electric wires; and including fixture fasteners further interconnecting the plug housing and the electric fixture.

12 Claims, 4 Drawing Sheets

CEILING ELECTRICAL CONNECTOR ASSEMBLY

FIELD OF THE INVENTION

This invention relates to electrical connector apparatus and assemblies. More particularly, this invention relates to such apparatus and assemblies which are particularly configured and adapted for releasably connecting electric ceiling fixtures to ceiling electric junction boxes.

BACKGROUND OF THE INVENTION

Electric ceiling fixtures such as ceiling fans, incandescent lights, and heaters are typically attached directly to a ceiling mounted electric junction box. Helically threaded mounting screws typically engage helically threaded apertures presented within inwardly extending flanges of the junction box, such screws securely supporting the ceiling fixture in the manner of suspension ties. Typically, such ceiling electric junction box receives and houses a terminal end of an electric power cable which makes up a part of the network of electrical wiring of the building or structure. Such electric cable terminal end typically includes a pair of "hot" insulated wires denominated "positive" and "negative" wires, and includes third neutral or ground wire. The ground wire may terminate either upon an exterior wall of the electric junction box (provided that the box is metal), or may alternately extend into the interior of the electric junction box. Such cable's positive and negative "hot" wires and third ground wire are typically electrically connected to the electric fixture's electric lead wires by means of manually installed electric wire connecting cable nuts.

Ceiling mounting of such electric ceiling fixtures typically requires the installation of at least two mounting screws, and at least three electric wire connecting cable nuts. Each of such screw or cable nut installations ideally is accomplished through two handed manipulations (e.g., one hand holding a screw while the other hand manipulates a screwdriver, or one hand holding paired wires while the other hand manipulates and twists a connecting cable nut). While such screws and nuts are installed the electric fixture is preferably held overhead in close proximity to the electric junction box to which it is to be attached. Ideally, the electric fixture is also securely held while the installation takes place. The needs for occupation of an installer's hands both for holding and supporting the electric ceiling fixture and for manipulating attachment fasteners undesirably conflict each other, complicating the ceiling fixture installation operation, and potentially making such operation dangerous.

The instant inventive ceiling electrical connector assembly solves or ameliorates problems discussed above by providing a connector assembly which allows an operator to securely use both hands to raise a ceiling fixture, to accomplish required electrical connections, and to securely, fixedly, and removably attach the ceiling fixture to the junction box.

BRIEF SUMMARY OF THE INVENTION

The preferred use environment of the instant inventive connector assembly comprises a common overhead electric junction box, such box receiving, typically through a sidewall "knockout plug", a terminal end of a building's power cable network. Typically, such terminal end will comprise terminal ends of "hot" positive and negative wires, and a terminal end of a neutral or ground wire. Where the electric junction box is composed of steel, the neutral or ground wire is commonly electrically connected by means of a fastening screw connecting the ground wire to an exterior wall of the electric junction box, while an interior copper ground wire tail is electrically connected to and extends from an interior wall of such junction box. Typically, the lower peripheral edge of such electric junction box presents laterally opposed inwardly extending attachment flanges, such flanges having helically threaded mounting screw receiving eyes.

The use environment of the instant inventive connector assembly preferably further comprises a common ceiling mounted electric fixture such as a ceiling fan, an electric incandescent ceiling light or an electric heater. Such electric fixtures typically present electric wire and ground leads extending to the fixture's network of electric power wires.

A major component of the instant inventive connector assembly comprises a socket housing having a lower end, the socket housing having a first and at least a second hook electrode receiving aperture therein. Preferably, a triple or first, second, and third hook electrode receiving apertures are presented, one for each of a positive electrode, negative electrode, and ground plug. Preferably, each of the socket housing's hook electrode receiving apertures is constantly or circularly curved about a common central point, and each such aperture preferably has a hook engaging end and a circumferentially opposite hook disengaging end. Preferably, the socket housing component of the instant inventive connector assembly internally presents and supports a series of hook engaging ledges or lands which correspond with the socket housing's hook electrode receiving apertures. Preferably, such lands are positioned so that they overlie such apertures' hook engaging ends.

A further structural component of the instant inventive connector assembly preferably comprises a plug housing having an upper end. A first and at least a second, and preferably a triple or first, second, and third hooks preferably are fixedly attached to and extend upwardly from the upper end of the plug housing. Each of the preferred first, second, and third hooks preferably comprises an electrically conductive metal blade. Such blades are preferably composed of a hardened brass alloy. Each such metal blade also preferably presents at its upper end a similarly constantly or circularly curved cantilevered hook arm, each of which preferably extends in the circumferential direction of the hook engaging ends of the socket housing's hook receiving apertures.

Suitably, the upper ends of the electrode hooks may be alternately configured as an enlarged head, or other commonly known hooking or latching configurations.

The socket housing and the plug housing preferably respectively house and support upper and lower terminal means, the upper terminal means providing for electrical connections between the building structure's network of electric power cables and the upper ends of the electrode hooks. The lower terminal means similarly facilitates electrical contact between lower ends of the electrode hooks and the electric ceiling fixture's network of electrical power wires.

Preferably, the inventive connector assembly further comprises releasable locks or latches which are adapted for fixedly positioning the plug housing in alignment directly underlying the socket housing. The releasable locks further fixedly suspend the plug housing from the socket housing while simultaneously holding the electrode hooks in their electrically contacting positions within the socket housing's electrode hook receiving apertures. Such releasable locking or latching means advantageously provide a mechanical backup or "fail-safe" to the suspending action provided by the mechanical inter-relationship of the electrode hooks and the socket housing's hook engaging lands.

Preferably, the lower terminal means, which electrically interconnect the ceiling fixture's network of power wires and the electrode hooks, are specially adapted to include normally open circuit breaking switches and actuator means mechanically linked to the preferred releasable latching or locking means. Preferably, such switches and actuators are configured so that, upon closing of the latching or locking means, electrical paths from the electrode hooks to the ceiling fixture's network of electric power lines are completed. Alternately, upon disengagement of any of such latches or locks, electrical power to the fixture is advantageously cut off. Such circuit breaking mechanical relationship provides an additional fail-safe, assuring that while the latches or locks are disengaged, electric power to the ceiling fixture is terminated.

In operation of the instant inventive connector assembly, a lay person may safely and conveniently install and de-install electric ceiling fixtures through simple steps of upward insertions of electrode hooks into electrode hook receiving apertures, rotation in a vertical plane of the plug housing and fixture with respect to the socket housing for engagement of electrode hooks with hook engaging lands, and manipulation of mechanical latches for simultaneously securing the plug housing beneath the socket housing while completing electrical paths between the building's network of electric power cables, and the ceiling fixtures network of electric power wires.

Accordingly, objects of the instant invention include the provision of a connector assembly, including structures components and features as described above, wherein such elements are capable of performing functions as described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
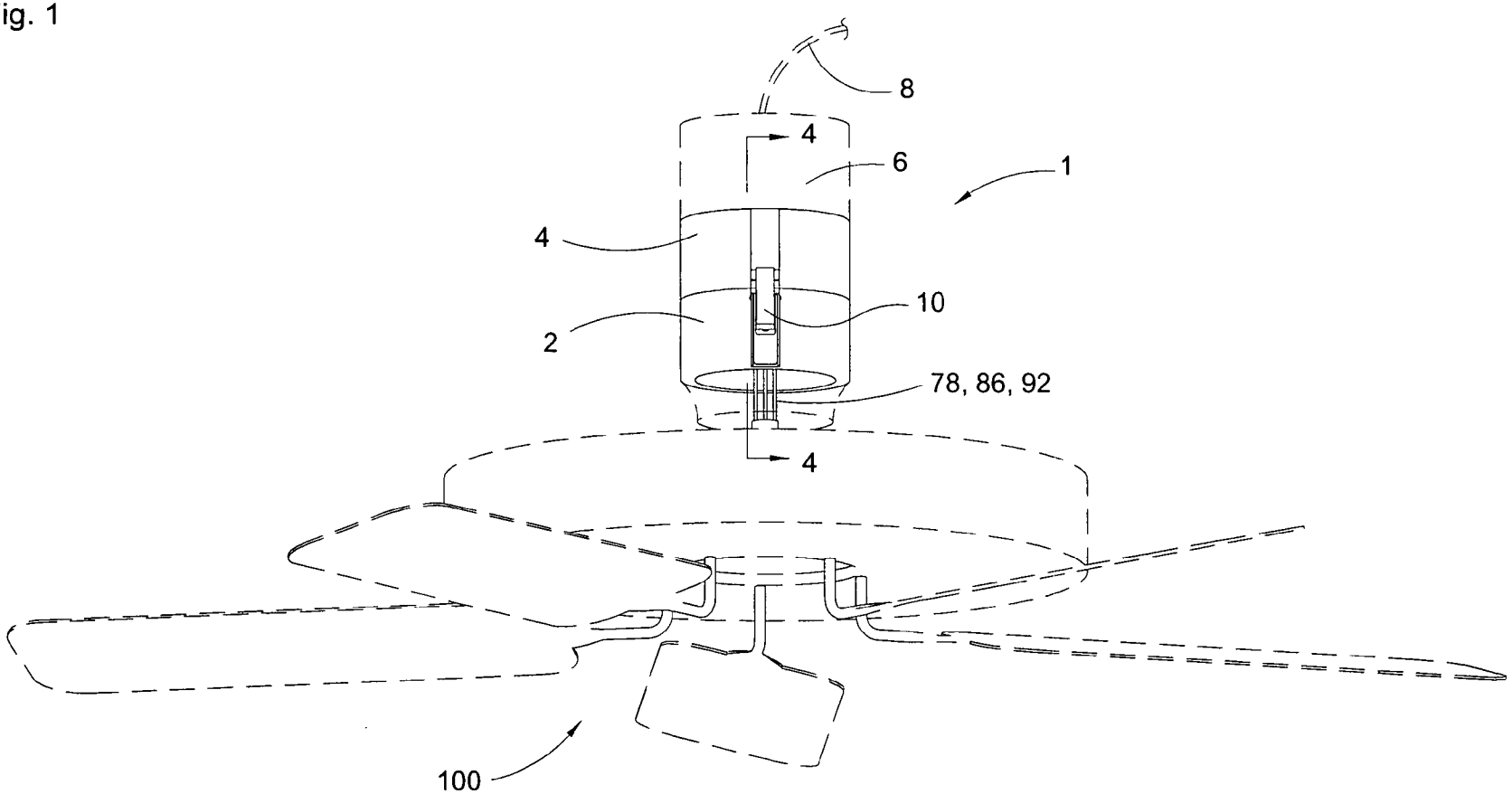
FIG. 1 is a perspective view of a preferred embodiment of the instant inventive ceiling electrical connector assembly.

Referring now to the drawings, and in particular to FIG. 1, a preferred embodiment of the instant inventive ceiling electrical connector assembly is referred to generally by Reference Arrow 1. Such assembly is typically fixedly mounted upon a common ceiling electric junction box 6, such box 6 typically receiving and housing terminal ends 8 of a building structure's network of electric power wires or cables.

Figure 2:
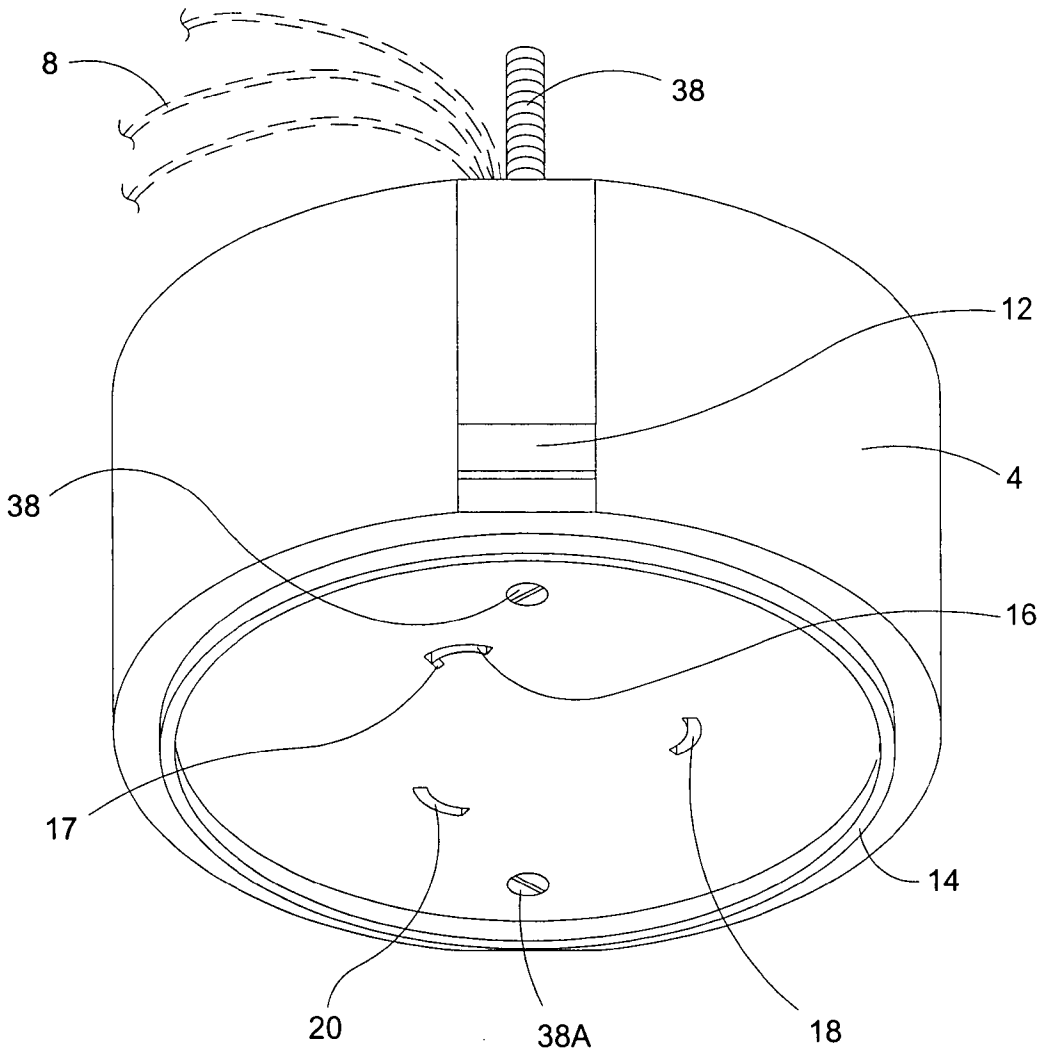
FIG. 2 is a disassembled view of the socket housing component of the instant inventive ceiling electrical connector assembly.
Figure 4:
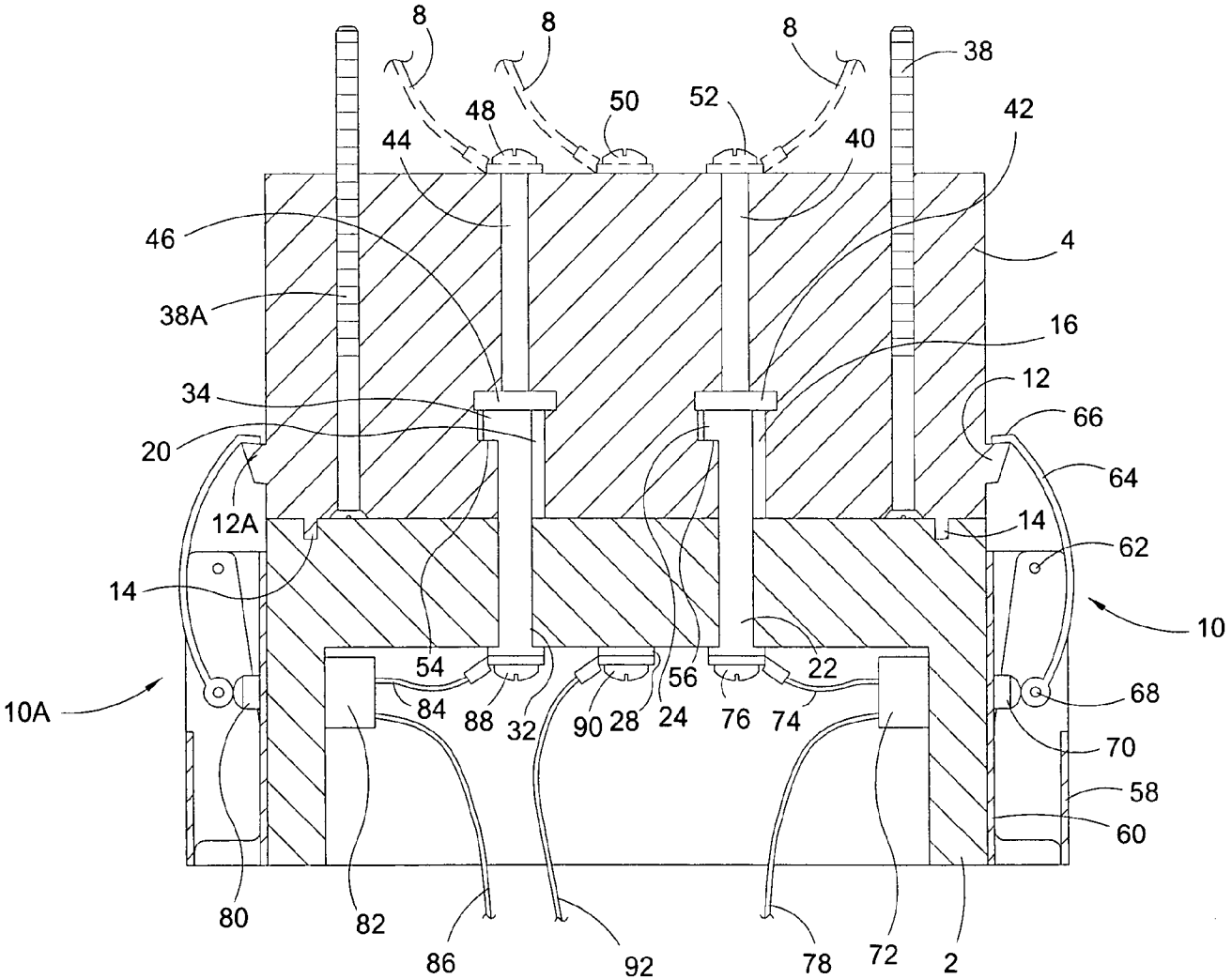
FIG. 4 is a sectional view as indicated in FIG. 1.

Referring simultaneously to FIGS. 1, 2, and 4, a socket housing 4 is provided. The socket housing 4 preferably is cylindrical in shape and is preferably composed of injection molded plastic. The socket housing 4 preferably presents a pair of laterally opposed and vertically extending mounting screw receiving channels, such channels receiving mounting screws 38 and 38A. Such ceiling electric junction boxes 6 typically present standardized mounting screw receiving apertures which may threadedly receive the upper ends of fixture mounting screws such as screws 38 and 38A. Such mounting screws 38 and 38A advantageously rigidly mechanically link the socket housing 4 to the lower surface of the ceiling electric junction box 6.

Referring simultaneously to FIGS. 2 and 4, the lower end of the socket housing 4 presents electrical hook receiving apertures 16, 18, and 20. Preferably, each of such electrode hook receiving apertures is substantially continuously or circularly curved about a common central point, such point preferably constituting the vertical midline axis of the socket housing 4. The preferred plastic structure of the socket housing is preferably configured to present a hook engaging land 54, such land 54 being positioned at a hook engaging end of the electrode hook receiving aperture 20, such land also being further positioned at an elevation overlying the lower opening of such aperture. The preferred plastic structure of the socket housing 4 is preferably further configured to similarly present a hook engaging land 56 at an upper or overlying position within the electrode hook receiving aperture 16 at such aperture's hook engaging end. The preferred plastic structure of the socket housing 4 is preferably further configured to similarly present a third hook engaging land (not depicted within views) within aperture 18.

Referring further simultaneously to FIGS. 2 and 4, the socket housing 4 preferably houses and rigidly supports upper terminal means for providing electrical connections at the terminal ends of the building structure's power wires 8. The upper terminal means preferably comprises a plastic embedded electrically conductive (preferably brass) terminal post 44, such post having a screw fastener type electrical connection 48 at its upper end. The lower end of the terminal post 44 is preferably fixedly attached to and electrically connected to a circularly curved electrical contact clip 46. Such contact clip preferably defines the extreme upper end of the electrode hook receiving aperture 20. The upper terminal means preferably further comprises a similarly configured second electrically conductive terminal post 40, such post being similarly embedded within the preferred plastic structure of the socket housing 4. Like the upper end of the terminal post 44, the upper end of the terminal post 40 preferably presents a screw fastener electrical connection 52 at its upper end, and presents at its lower end a circularly curved electric contact clip 42. Similarly with contact clip 46, such clip 42 defines the extreme upper end of the hook electrode receiving aperture 16. The plastic structure of the socket housing 4 preferably further houses and rigidly supports a third electrically conductive terminal post (not within view) which, similarly with posts 40 and 44 spans between a screw electrical connector 50 and a third circularly curved electric contact clip (not within view). Like contact clips 42 and 46, such third contact clip defines the extreme upper end of the electrode hook receiving aperture 18.

Referring further simultaneously to FIGS. 2 and 4, the outer wall of the socket housing 4 preferably presents laterally oppositely positioned latch engaging lugs or protrusions 12 and 12A, each of such lugs 12 or 12A presenting an upper latch hook engaging land.

Referring further simultaneously to FIGS. 2 and 4, a circular mounting alignment ridge 14 is preferably wholly formed with the socket housing 4, such ridge extending downwardly from the lower end of the socket housing 4.

Referring simultaneously to FIGS. 1, 2, and 4, upon installation of the socket housing 4 upon ceiling electric junction box 6, screw electrical connectors 48, 50, and 52 may secure the terminal ends of wires 8 to the upper ends of the electrically conductive terminal posts. Such interconnection advantageously extends the building structure's supply of electrical power to the circularly curved contact clips at the lower ends of the terminal posts. For reasons further discussed below, at least one of the electrode hook receiving apertures 16 is preferably configured to present a negative key 17 at one of its circumferential ends.

Figure 3:
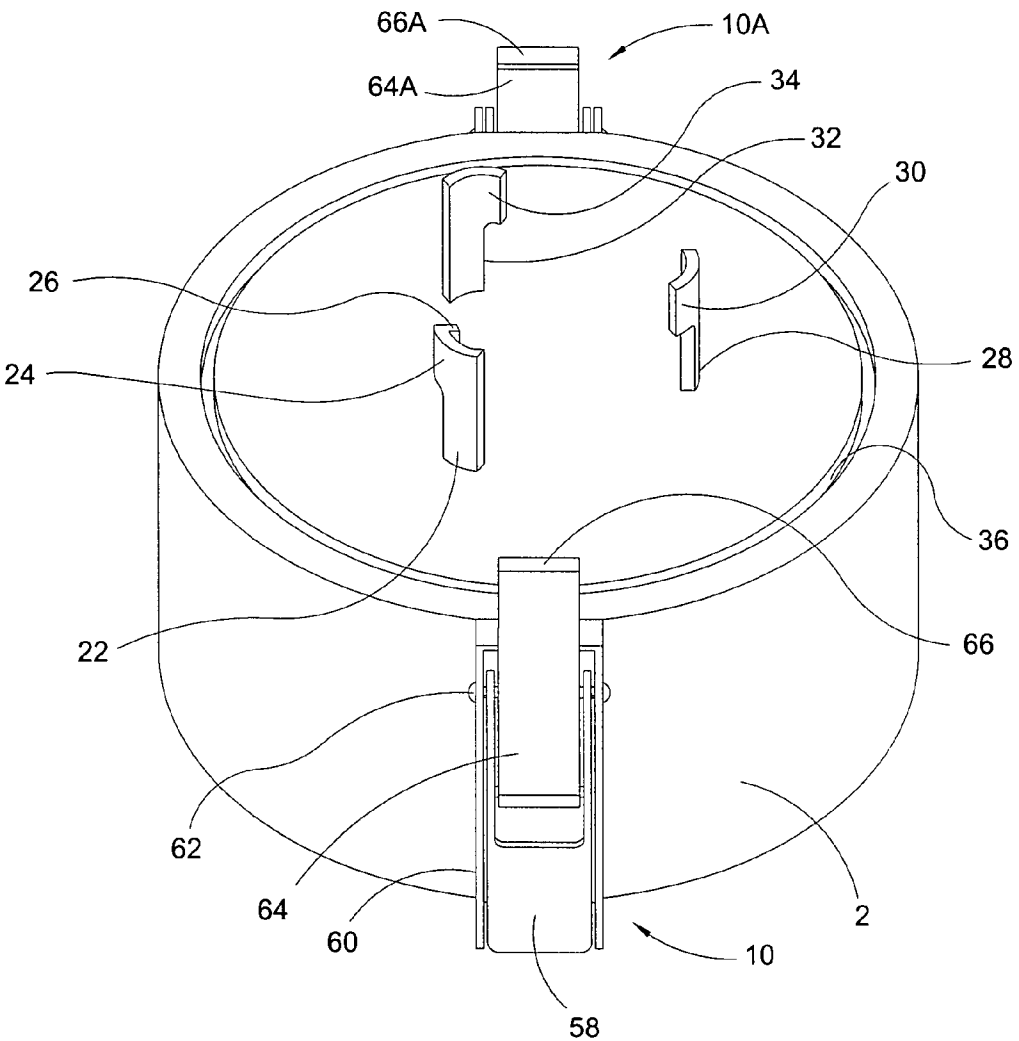
FIG. 3 is a prospective view of the plug housing component of the instant inventive ceiling electrical connector assembly.

Referring simultaneously to FIGS. 1, 3, and 4, a plug housing 2 is preferably provided, the plug housing 2, like the socket housing 4, preferably comprising injection molded plastic. The upper end of the plug housing 2 preferably is configured to include a circumferential channel 36 which is closely fitted for receiving the circumferential ridge 14 of the socket housing 4. Nesting receipt of the circumferential ridge 14 within the circumferential channel 36 advantageously provides for accurate alignment of the plug housing 2 with respect to the socket housing 4, and provides for subsequent rotary movement and radial alignment of the plug housing 2 with respect to the socket housing 4.

Referring simultaneously to FIGS. 2, 3 and 4, electrically conductive (preferably brass) hook electrodes 22, 28, and 32 are preferably embedded within and are rigidly secured by the preferred plastic structure of the plug housing 2. Such hook electrodes are preferably oriented so that they extend upwardly from the upper end of the plug housing 2. The upwardly protruding ends of the electrode hooks 22, 28, and 32 are preferably configured as circularly curved blades, each blade preferably having a center of curvature in common with each other blade. Similarly with the preferred center of curvature of the electrode hook receiving apertures 16, 18, and 20, the vertical midline axis of the plug housing 2 preferably provides a common center of curvature for the electrode hooks 22, 28, and 32.

Referring further simultaneously to FIGS. 2, 3 and 4, the plug housing 2 preferably supports and houses lower terminal means, such means preferably comprising screw connectors 76, 88, and 90. Such connectors are preferably threadedly supported at the lower ends of the electrode hooks 22, 28, and 32. The lower terminal means preferably further comprises at least a first, and preferably an oppositely positioned pair of normally open electric circuit breaking switches 72 and 82. Where, for example, electrode hooks 22 and 32 serve as "hot" positive and negative electrodes, and where electrode hook 28 is a neutral ground, the circuit breaking switches 72 and 82 normally break or interrupt the supply of electrical power which may be conducted via electrode hooks 22 and 32 and via lead wires 74 and 84.

Referring to FIGS. 3 and 4, each of the electrode hooks 22, 28, and 32 preferably presents at its upper end a cantilevered hook arm, respectively, 24, 30, and 34. The lower surfaces or downwardly oriented faces of such cantilevered hook arms 24, 30, and 34 advantageously present a triple of load bearing surfaces which are engageable with the socket housing's hook engaging lands.

Referring to FIGS. 2 and 3, the distal end of the cantilevered arm 24 of the hook electrode 22 preferably includes a positive key 26, such positive key being fitted for slidable insertion within the negative key 17 of electrode receiving aperture 16. By providing such positive key 26 and negative key 17 mechanical inter-relationship, users and operators of the instant inventive assembly may be assured that the hook electrodes 22, 28, and 32 are insertable into the electrode receiving apertures 16, 18, and 20 only in a proper orientation. Such keying assures that the hook electrode which is intended to serve as a protective neutral or ground is properly connected electrically with the building structure's neutral or ground wire.

Referring simultaneously to FIGS. 1, 3, and 4, a pair of laterally opposed manually operable over-center latches 10 and 10A are preferably provided. The over-center latch 10 preferably comprises a base member 60 which is rigidly and fixedly attached to the side wall of the plug housing 2. Preferably, such base member 60 is centrally apertured to allow an outwardly spring biased actuator shaft 70 extending from and reciprocatingly moveable therein. A pivoting lever member 58 of the over-center latch 10 is preferably mounted pivotally upon the base member 60 by a pivot pin 62. A latch member 64 having a hook 66 at its upper end is preferably pivotally mounted to the lever member 60 by a pivot pin 68. The lower end of the latch member 64 is preferably oriented and positioned so that, upon latching over-center engagement of the hook 66 with the hook engaging land of lug 12, such lower end may inwardly depresses actuator shaft 70 for closing the normally open switch 72. The laterally opposite over-center latch 10A is preferably configured substantially identically with latch 10 for inward depression of actuator shaft 80 and resultant closure of normally open switch 82 upon over-center latching engagement with the upper land of lug 12A.

Referring simultaneously to all figures, the dashed line structure identified by Reference Arrow 100 is a depiction of a common electric ceiling fan. However, such depiction is intended as representative of various other types of common ceiling mounted electric fixtures such as incandescent lamps and electric heaters. The representative electric ceiling fixture 100 typically includes a network of electric power wires which includes at least a triple of electric wire leads 78, 86, and 92. Such lead wires typically serve as "hot" positive and negative, and as a neutral or ground electric lead. Preferably, the housing of the electric ceiling fixture 100 is either wholly formed with or is fixedly attached to the lower end of the plug housing 2.

Referring further simultaneously to all figures, at the commencement of assembly of the instant invention 1, electrical contact screws 48, 50, and 52 are initially removed, mounting screws 38 and 38A are initially withdrawn from their mounting screw channels and plug housing 2, along with its connected ceiling fixture 100, are initially disengaged and set aside from socket housing 4. Thereafter, the contact screws 48, 50, and 52 are successively extended through screw eyes at the terminal ends of structural wires 8. Thereafter, contact screws 48, 50, and 52 are threadedly remounted within threaded apertures within the exposed upper ends of the terminal posts 44, 40, and within the third terminal post (not within view). Upon reinstallation of such screws 48, 50, and 52, a substantially permanent electrical connection between the building structure's electric power network and the socket housing 4 is advantageously provided. After establishing such electrical connection, mounting screws 38 and 38A may be re-extended upwardly through their channels for secure mounting of the socket housing 4 against the lower end of the electric junction box 6 in the manner described above. Upon such mounting, the socket housing 4 advantageously serves as a substantially permanent ceiling fixture.

Thereafter, referring further simultaneously to all figures, such operator may securely grasp the housing of the electric ceiling fixture 100 in both hands, and such operator may raise such housing along with its attached plug housing 2 upwardly toward the lower end of the socket housing 4.

While so raising such assembly, the operator may accurately rotate and align, within a horizontal plane, both the electric fixture 100 and the plug housing 2 so that both the upper end of the hook electrode 22 and the upper end of its positive key 26 directly underlie the lower opening of the socket housing's electrode receiving aperture 16 and its negative key 17. Thereafter, such operator may upwardly extend the entire ceiling fixture 100 and plug housing 2 combination upwardly, causing the electrode hooks 22, 28, and 32 to enter their respective electrode hook receiving apertures 16, 18, and 20, and establishing electrical contacts with such apertures' overlying electrical contact clips. Thereafter, such operator may rotate the ceiling fixture 100 and plug housing 2 assembly counter-clockwise, causing the hook electrodes 22, 28, and 32 to rotatably travel from the hook disengaging ends of their respective electrode receiving apertures to such apertures' hook engaging ends. Upon rotating movement to such apertures' hook engaging ends, the cantilevered hooks 24, 30, and 34 advantageously overlie and engage lands presented by the interior structure of the socket housing 4. Upon such rotary movement for engagement of hooks with lands, the over-center latches 10 and 10A also preferably move simultaneously into alignment with the lugs 12 and 12A presented at opposite sides of the socket housing 4.

Upon completion of such vertical and rotary positioning of the ceiling fixture 100 and plug housing 2, the operator may safely release his or her grasp upon the housing of the electric fixture 100, and may temporarily allow the fixture 100 and its attached plug housing 2 to suspend from its electrode hooks 22, 28, and 32. Thereafter, the operator may pivot the lever member 58 of over-center latch 10 upwardly, and may position the hook 66 at the upper end of the latch member 64 in direct contact with the upper land of lug 12. Thereafter, the operator may pivot the lever member 58 clockwise about pivot pin 62 until the lower end of the latch member 64 drives inwardly against the outer end of actuator shaft 70, latching and locking the over-center latch 10, while simultaneously closing switch 72 and completing an electrical path from electrical contact screw 52 to wire 78. Thereafter, over-center latch 10A may be similarly manipulated for completing an electrical path from electrical contact screw 48 to wire 86. Upon opposite disengagement of either of the over-center latches 10 or 10A, electrical power to the electric ceiling appliance 100 is beneficially terminated. Where the electric ceiling fixture comprises a ceiling fan, such electric cut-off function is particularly advantageous, eliminating the hazardous eventuality of the fan falling while powered and operating.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A connector assembly for interconnecting an overhead electric junction box and electric fixture, the overhead electric junction box receiving a terminal end of a network of structural electric power wires, the electric fixture comprising a network of fixture power wires, the connector assembly comprising:

(a) a socket housing having a lower end, the socket housing's lower end having a first and at least a second aperture, each aperture among the first and at least second apertures having a hook engaging end, and a hook disengaging end, the socket housing internally supporting a first and at least a second land, the first and at least second lands respectively overlying the first and at least second apertures' hook engaging ends;

(b) a plug housing having an upper end;

(c) a first and at least a second hook, each hook among the first and at least second hooks extending externally from the plug housing's upper end, each hook among the first and at least second hooks comprising an electrically conductive material, the first and at least second hooks being, upon respective extensions into the first and at least second apertures, respectively movable between the first and at least second apertures' hook engaging and hook disengaging ends;

(d) upper terminal means connected operatively to the socket housing, the upper terminal means having upper and lower ends, the upper terminal mean's upper end being adapted for electrical connection with the structural power wire network's terminal end, the upper terminal mean's lower end being adapted for, upon respective extensions of the first and at least second hooks into the first and at least second apertures, electrically contacting the first and at least second hooks;

(e) lower terminal means connected operatively to the plug housing, the lower terminal means being adapted for electrically connecting the first and at least second hooks to the electric fixture's network of fixture power wires; and (f) releasable locking means connected operatively to the socket and plug housings, the releasable locking means being adapted for releasably suspending the plug housing from the socket housing; the lower terminal means comprising at least a first normally open circuit breaking switch, and further comprising circuit closing means connected operatively to the plug housing, the circuit closing means being adapted for, upon locking of the releasable locking means, closing the at least first normally open circuit breaking switch.

2. The connector assembly of claim 1 wherein the socket housing further comprises a plurality of mounting screw receiving channels and a plurality of mounting screws extending through the mounting screw receiving channels, the mounting screws being adapted for threaded engagement with the overhead electric junction box.

3. The connector assembly of claim 1 wherein the releasable locking means comprises a plurality of over-center latches.

4. The connector assembly of claim 3 further comprising a plurality of latch engaging lands fixedly attached to or formed wholly with the socket housing, the latch engaging lands being, upon respective movements of the first and at least second hooks to the first and at least second apertures' hook engaging ends, engageable with the over-center latches.

5. The connector assembly of claim 1 wherein the circuit closing means comprises at least a first outwardly spring biased actuator.

6. The connector assembly of claim 1 wherein the socket housing's lower end further has a third aperture, the third aperture having a hook engaging end and having a hook disengaging end, wherein the socket housing further internally supports a third land, the third land overlying the third aperture's hook engaging end, and further comprising a third hook extending from the plug housing's upper end, the third hook comprising an electrically conductive material, the third hook being, upon extension into the third aperture, moveable between the third aperture's hook engaging and hook disengaging ends.

7. The connector assembly of claim 6 wherein the upper terminal means is further adapted for, upon extension of the third hook into the third aperture, electrically contacting the third hook.

8. The connector assembly of claim 7 wherein the lower terminal means is further adapted for electrically connecting the third hook to the electric fixture's network of fixture power wires.

9. The connector assembly of claim 6 wherein at least a first hook among the first, second, and third hooks is positively keyed, and wherein at least a first aperture among the first, second, and third apertures is matchingly negatively keyed.

10. The connector assembly of claim 6 wherein each hook among the first, second, and third hooks comprises a substantially constantly curved metal blade, each such blade having a center of curvature, each metal blade's center of curvature substantially coinciding with each other metal blade's center of curvature.

11. The connector assembly of claim 10 wherein each metal blade has an upper end, and further comprising a triple of cantilevered extensions, each cantilevered extension among the triple of cantilevered extensions being fixedly attached to or formed wholly with one of the metal blade's upper ends.

12. The connector assembly of claim 1 wherein at least a first hook among the first and at least second hooks is positively keyed, and wherein at least a first aperture among the first and at least second apertures is matchingly negatively keyed.

* * * * *